US007185791B2

(12) United States Patent
Lasser et al.

(10) Patent No.: US 7,185,791 B2
(45) Date of Patent: Mar. 6, 2007

(54) APPARATUS FOR METERING AND DISPENSING POWDERED PRODUCT, AND METHOD FOR REPLACING A FILLER WHEEL FOR SUCH AN APPARATUS

(75) Inventors: Markus Lasser, Schwaebisch Hall (DE); Thomas Abel, Rosengarten (DE); Friedrich Herrmann, Blaufelden (DE)

(73) Assignee: Robert Bosch GmbH, Stuttgart (DE)

( * ) Notice: Subject to any disclaimer, the term of this patent is extended or adjusted under 35 U.S.C. 154(b) by 501 days.

(21) Appl. No.: 10/821,908

(22) Filed: Apr. 12, 2004

(65) Prior Publication Data

US 2004/0251281 A1 Dec. 16, 2004

(30) Foreign Application Priority Data

Jun. 10, 2003 (DE) ..... 103 26 039

(51) Int. Cl.
*G01F 11/10* (2006.01)

(52) U.S. Cl. ..... 222/368; 141/144

(58) Field of Classification Search ..... 222/367–371, 222/288, 296, 298, 299, 303, 305, 319, 400, 222/363, 135, 144, 289, 292, 294, 278, 279; 141/144, 151, 67, 129, 103, 71
See application file for complete search history.

(56) References Cited

U.S. PATENT DOCUMENTS

| | | | | |
|---|---|---|---|---|
| 4,531,658 | A * | 7/1985 | Galopin | 222/181.2 |
| 4,602,727 | A * | 7/1986 | Jackson | 222/368 |
| 4,635,829 | A * | 1/1987 | Brittingham, Jr. | 222/278 |
| 4,671,430 | A * | 6/1987 | Dinius | 222/135 |
| 5,002,084 | A * | 3/1991 | Wilson | 137/15.24 |
| 6,059,147 | A * | 5/2000 | Yuen et al. | 222/181.3 |
| 6,182,712 | B1 * | 2/2001 | Stout et al. | 141/18 |
| 6,283,176 | B1 * | 9/2001 | Wurst et al. | 141/144 |
| 6,755,223 | B1 * | 6/2004 | Trebbi et al. | 141/129 |

* cited by examiner

*Primary Examiner*—Lien M. Ngo
(74) *Attorney, Agent, or Firm*—Ronald E. Greigg

(57) ABSTRACT

The present invention relates to an apparatus for metering and dispensing powdered product into containers, including a storage chamber for receiving the product, an incrementally rotating filler wheel that has at least one metering opening, the filler wheel in a first position receiving product from the storage chamber and in a second position dispensing the received product to a container, and a closure element, which is disposed adjacent to the filler wheel and can be connected to the filler wheel in such a way that upon a motion of the filler wheel into its replacement position, the closure element is disposed below the storage chamber, to prevent the escape of product from the storage chamber.

20 Claims, 5 Drawing Sheets

2
9
8
4
3
5
10
7
7
10

APPARATUS FOR METERING AND DISPENSING POWDERED PRODUCT, AND METHOD FOR REPLACING A FILLER WHEEL FOR SUCH AN APPARATUS

BACKGROUND OF THE INVENTION

1. Field of the Invention

The present invention relates to an apparatus for metering and dispensing powdered product into containers and to a method for replacing a filler wheel used in such an apparatus.

2. Description of the Prior Art

Powder dispensing machines of the type with which this invention is concerned for dispensing a powdered product have a reservoir in which the powdered product is disposed. Underneath the reservoir, there is a filler wheel which has at least one metering opening into which the powdered product is placed from the storage chamber, in the filling position of the filler wheel. Next, the filler wheel is rotated into a product dispensing position, in which the product is dispensed into vials or small bottles or other containers.

Since such powder dispensing machines are required to dispense various batches containing different quantities, or because of wear and soiling, it is necessary to be able to replace the filler wheels. However, this involves very great effort and expense and in particular entails a tedious cleaning process. The storage chamber located above the filler wheel must be completely emptied before the filler wheel is removed. At present, this is accomplished by evacuating the storage chamber by suction.

It has been found that the powdered product can often not be removed completely by the suction evacuation, and thus when the filler wheel is removed, the product gets into the regions of the powder dispensing machine located under the storage chamber and causes contamination there. In addition, changing the filler wheel is very time-consuming, causing the machine to have a long down time. For replacing the filler wheel, it is also necessary to use complicated equipment for fixing the filler wheel when it is being installed and removed. Since such powder dispensing machines are used primarily for dispensing powdered pharmaceutical products, provision must be made for providing a sterile environment when the filler wheel is changed, or performing sterilization before the filler wheel is installed, and this also applies to the devices needed for changing the filler wheel.

OBJECT AND SUMMARY OF THE INVENTION

The apparatus according to the invention for metering and dispensing powdered product into containers has the advantage over the prior art that for changing the filler wheel, there is no need to extract the powdered product from a reservoir. This advantage is attained according to the invention by disposing a closure element next to the filler wheel that can be connected to the filler wheel in such a way that, upon a motion of the filler wheel from an operating position into a replacement position in which the filler wheel is replaced, the closure element is disposed below the storage chamber. As a result, in the replacement position of the filler wheel, the product can be prevented from escaping from the storage chamber. Thus when the filler wheel and the closure element are put in this position, the filler wheel can be released from the closure element and easily replaced, without the possibility that the powdered product can trickle into the regions below the storage chamber.

To achieve a dimensionally accurate disconnection of the filler wheel and the storage chamber, the closure element preferably has the same outer shape, on its side toward the storage chamber, as the filler wheel. As a result, secure, tight sealing off of the storage chamber is achieved.

To attain improved sealing between the storage chamber and the closure element, spring-loaded sealing elements are preferably provided. These sealing elements are operative between the closure element and the storage chamber and furnish improved sealing between these two components.

To simplify the handling of the replacement of the filler wheel, a drive mechanism is preferably provided, which moves the filler wheel and the closure element connected to it from an operating position into a replacement position. The drive mechanism is especially preferably embodied by a pneumatic drive mechanism.

To achieve further simplification upon changing the filler wheel, a changing implement can preferably be secured to the filler wheel. This changing implement preferably includes two handles on the sides that simplify manipulation in the changing operation. Thus by grasping the handles, one can simply pull the filler wheel off. The changing implement is preferably formed of a sheet-metal material.

To enable a simple release of the filler wheel from the closure element, the filler wheel and the closure element are preferably connected by means of a screw connection and/or a clamping connection.

To enable simplified installation of the filler wheel, a guide element is preferably disposed on the closure element. This guide element serves to put the filler wheel into position and to guide it during the installation.

The method of the invention for replacing a filler wheel of a powder dispensing machine includes the steps of moving the filler wheel from an operating position into a replacement position, while at the same time moving a closure element connected to the filler wheel into the original operating position of the filler wheel. As a result, the closure element closes the connecting conduit from the storage chamber so that no powdered product can escape from the storage chamber. In the replacement position, the filler wheel is then released from the closure element and can be replaced simply, quickly and inexpensively. There is no risk then that the powder dispensing machine will become soiled with product.

The metering and dispensing apparatus described is used in particular for metering and dispensing pharmaceutical powdered products into small glass bottles or vials or other containers.

BRIEF DESCRIPTION OF THE DRAWINGS

The invention will be better understood and further objects and advantages thereof will become more apparent from the ensuing detailed description of a preferred embodiment taken in conjunction with the drawings, in which.

DESCRIPTION OF THE PREFERRED EMBODIMENT

Figure 1:
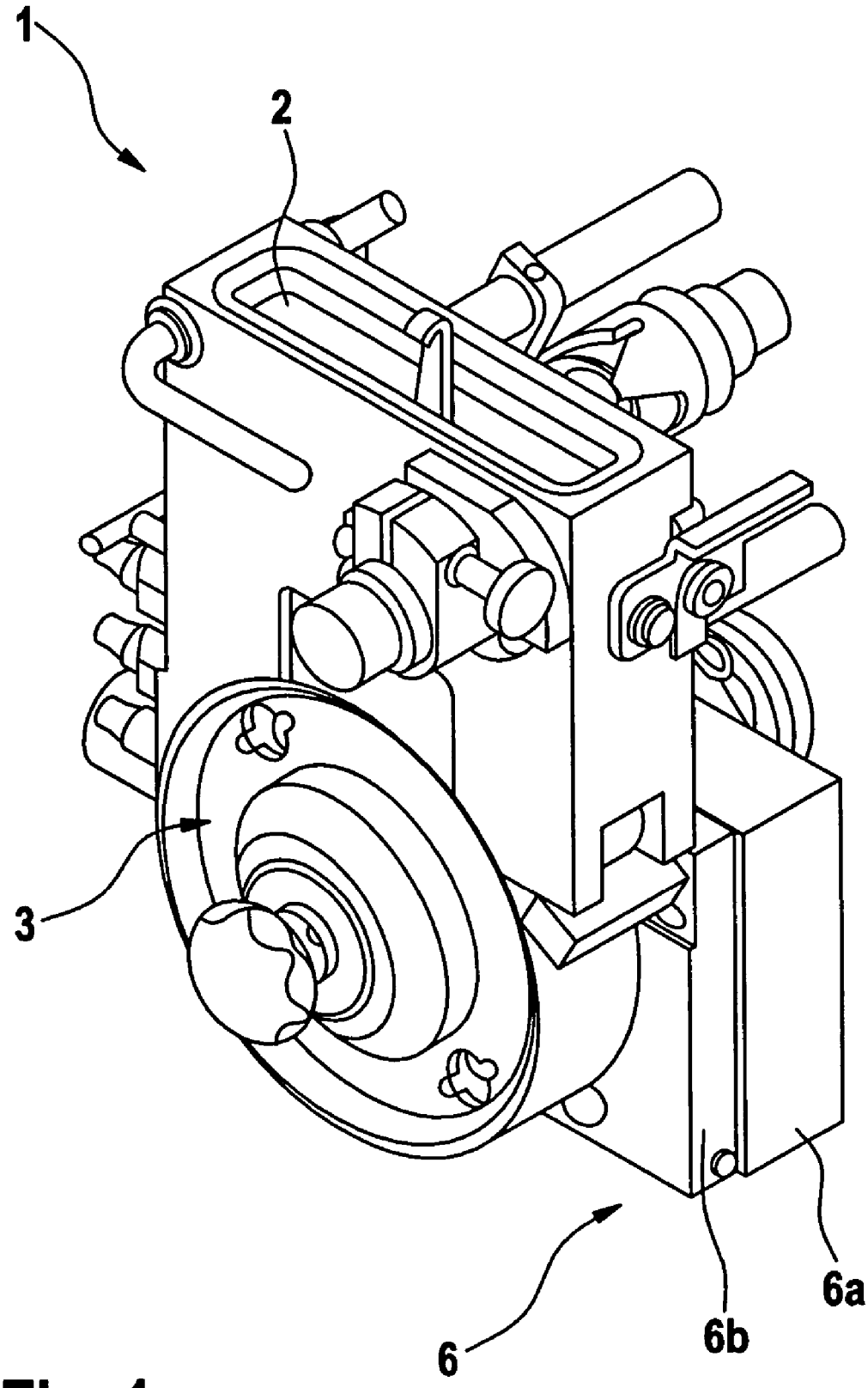
FIG. 1 is a perspective view of a powder dispensing machine in one exemplary embodiment of the invention, showing the filler wheel in its operating position.
Figure 2:
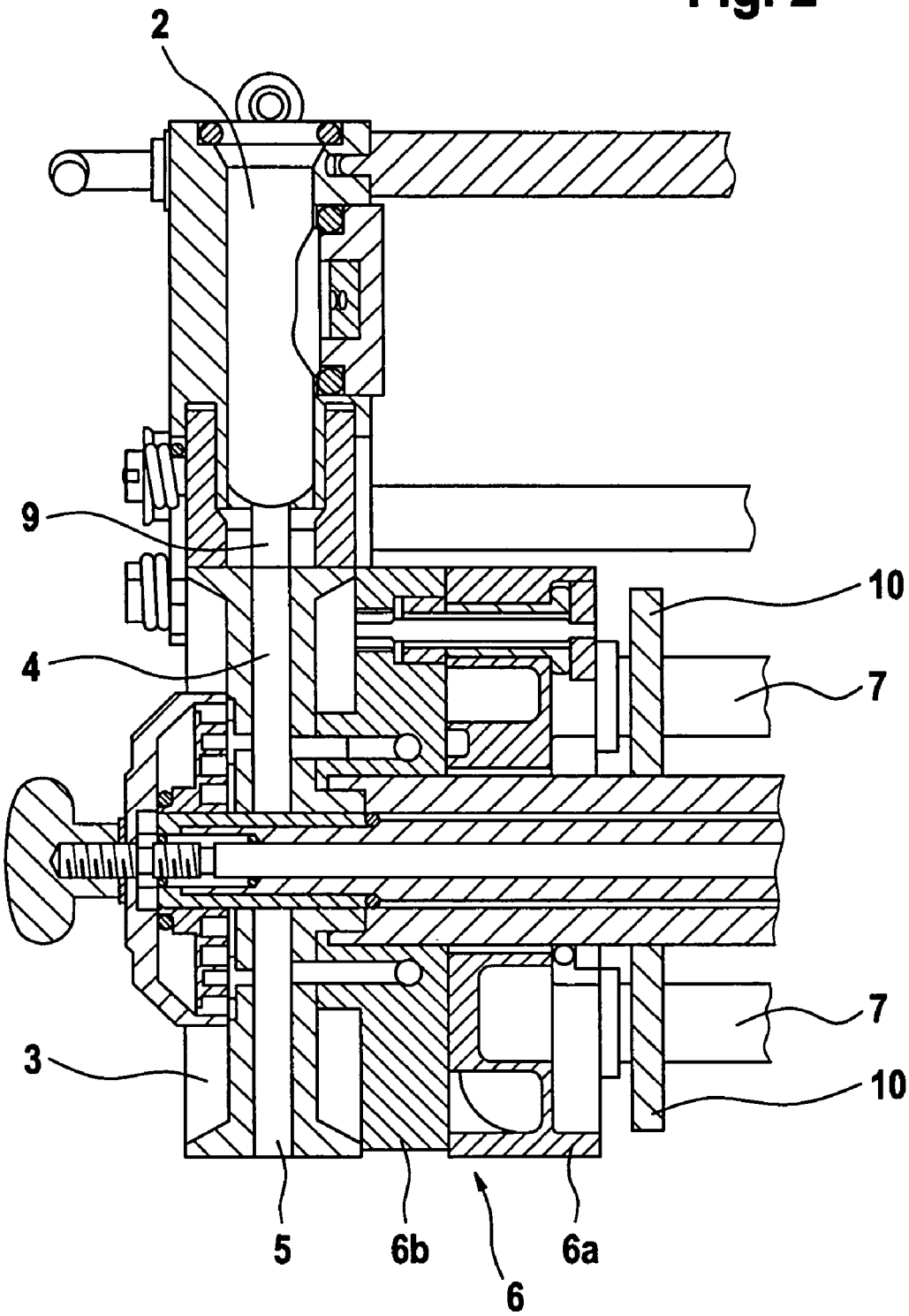
FIG. 2 is a schematic sectional view of FIG. 1.

One exemplary embodiment of a powder dispensing machine of the present invention is shown in the operating state in FIGS. 1 and 2. The powder dispensing machine 1 includes a storage chamber 2, in which a powdered product is received. Below the storage chamber 2 is a rotatably supported filler wheel 3. As shown in FIG. 2, a plurality of bores, which act as metering units 4 and 5, are made in the filler wheel 3.

As seen in FIG. 2, the powder located in the storage chamber 2 is delivered to the metering unit 4 via a connecting conduit 9, in the outset position of the filler wheel 3. Next, the filler wheel is rotated 180°, so that the metering unit 4 is now in a dispensing position, and the powder is dispensed from the metering unit 4, for instance in two small bottles. The process of filling and evacuating the metering units 4, 5 of the filler wheel 3 is reinforced by the generation of a vacuum and an overpressure, respectively.

Figure 3:
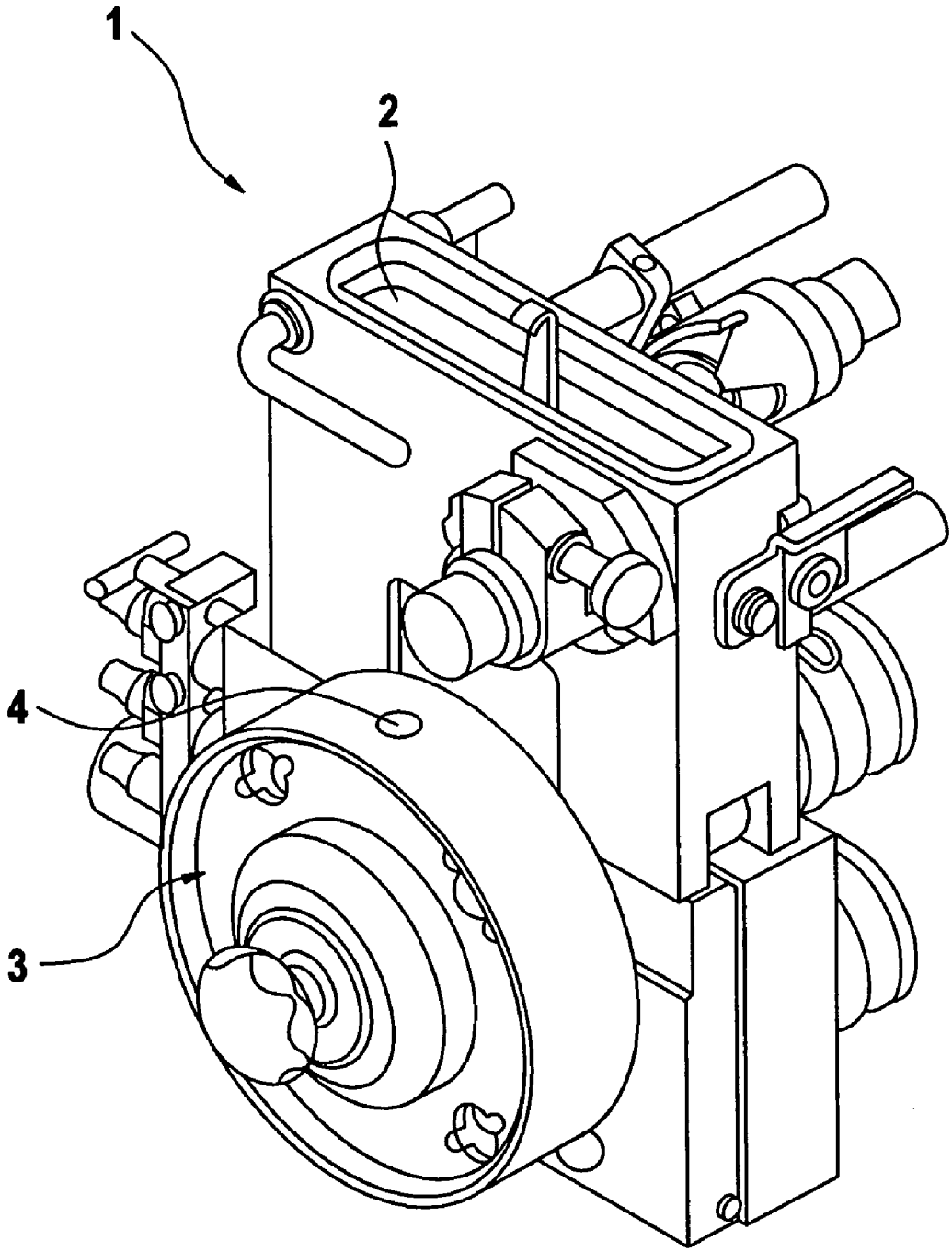
FIG. 3 is a schematic perspective view of the powder dispensing machine of FIG. 1, showing the filler wheel in its replacement position.
Figure 4:
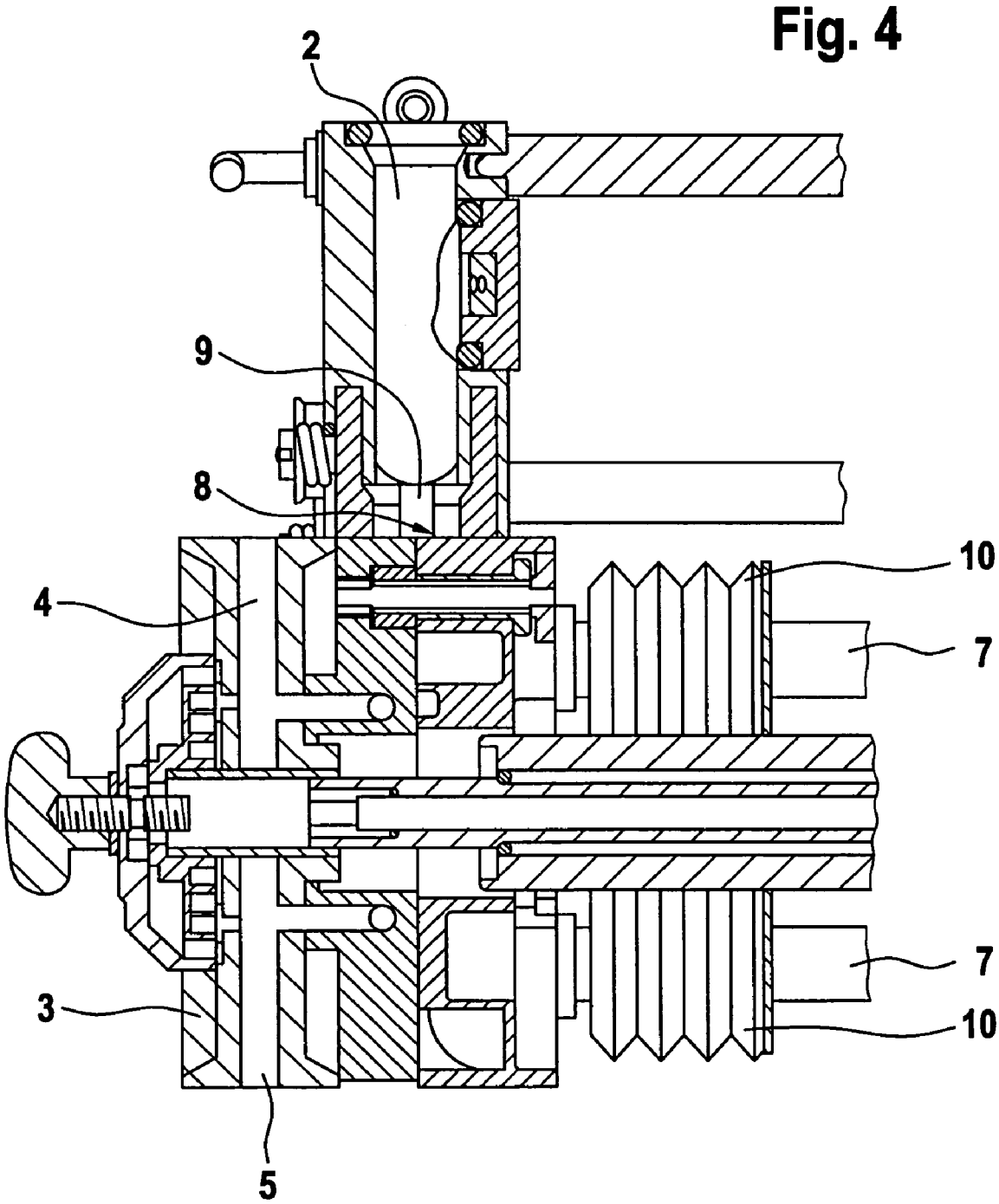
FIG. 4 is a schematic sectional view of FIG. 3.

In FIGS. 3 and 4, the removal position of the filler wheel 3 is shown. A filler wheel has to be removed for instance when the powder dispensing machine 1 is to be used for a different batch or other quantities filling it, or if it becomes soiled or worn, which causes inaccuracies in metering. As seen from FIGS. 2 and 4, a closure element 6 is located immediately adjacent the filler wheel 3. The closure element 6 is in two parts and comprises a first part 6*a* with a control crescent 15 (FIGS. 6 and 7) and a second part 6*b*, on which pneumatic cylinders 7 are disposed. The two parts 6*a* and 6*b* are solidly joined to one another.

As FIG. 4 shows, in the position for changing the filler wheel 3, the closure element 6 is disposed, in the original operating position of the filler wheel 3, under the storage chamber. The closure element 6 has been displaced toward the left, in terms of FIG. 4, by a distance approximately equivalent to the width of the filler wheel 3. An outer shape 16 (FIGS. 5–7) of the closure element 6, on the side of the closure element toward the storage chamber 2, is embodied identically to the outer shape of the filler wheel 3. As a result, the connecting conduit 9 is closed by the closure element 6. For improving the tightness, resilient sealing elements 8 are additionally provided on the closure element 6; they are relaxed when the filler wheel is being changed. The pneumatic cylinders 7 are also surrounded by a bellows-like sterile cover 10, to guarantee the operating safety of the powder dispensing machine 1.

Figure 5:
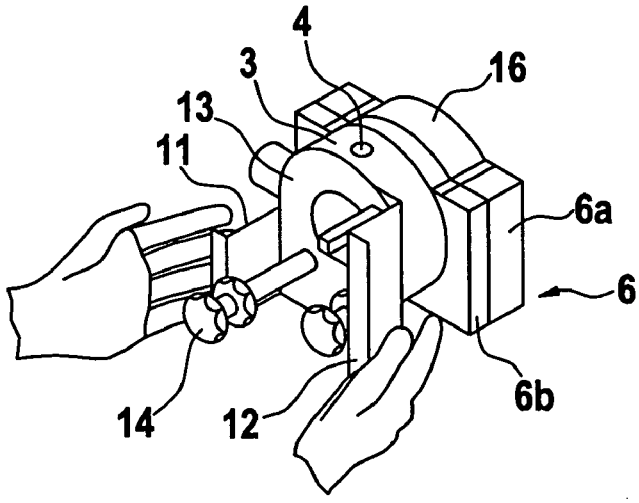
FIGS. 5–7 are schematic elevation views showing the operation of removing the filler wheel from the closure element.
Figure 6:
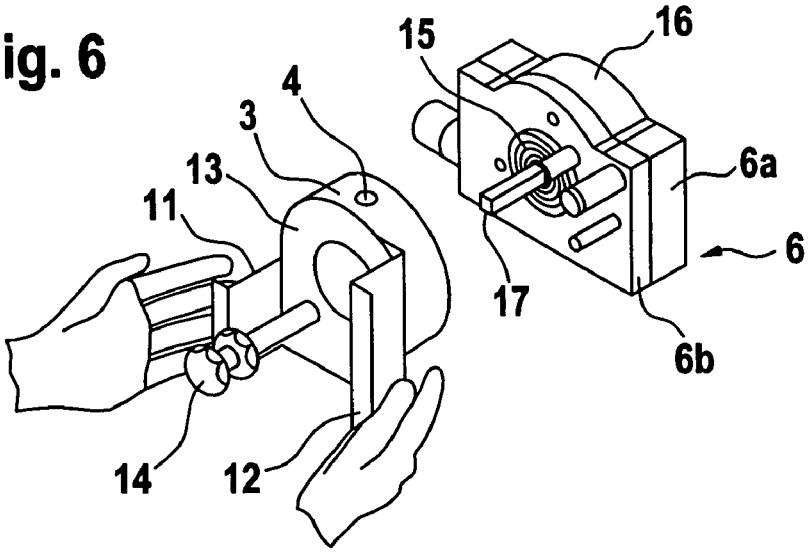
Figure 7:
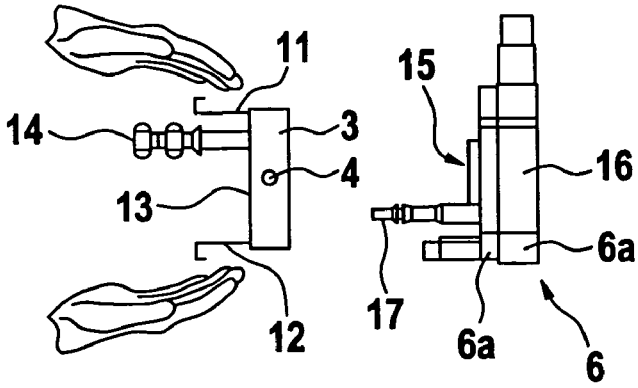

In FIGS. 5–7, the operation of changing the filler wheel is shown in detail, without the other components of the powder dispensing machine. As FIG. 5 shows, a clamping and locking pin 17 is first introduced, for connecting the filler wheel 3 to the closure element 6. Next, a substantially U-shaped sheet-metal construction 13 is secured to the filler wheel 3 by means of screw connections 14. The sheet-metal construction 13 has a first handle 11 and a second handle 12 on its sides. Once the sheet-metal construction 13 has been screwed onto the filler wheel, the filler wheel 3 can thus be pulled into the changing position (FIG. 4) jointly with the closure element 6. This is represented in FIGS. 5–7 by the schematically drawn hands.

To keep the expenditure of force by a user as slight as possible, the operation of assuming the position for changing the filler wheel 3 is reinforced pneumatically by the pneumatic cylinders. Once the unit comprising the filler wheel 3 and the closure element 6 has been put into the changing position, the locking of the pin 17 is undone, so that the filler wheel 3 can be simply pulled off from the closure element 6. This makes it possible to change the filler wheel quickly and simply.

Since the closure element 6, in its region oriented toward the storage chamber 2, has an outer contour 16 corresponding to that of the filler wheel 3, or in other words a curvature corresponding to that of the filler wheel (compare FIGS. 5 and 6), a more-secure and tight closure of the storage chamber 2 at the connecting conduit 9 is made possible. As a result, for changing the filler wheel 3, the storage chamber 2 need no longer be completely emptied of powdered product, for instance by means of suction extraction. Thus in the powder dispensing machine 1 of the invention, a change of the filler wheel 3 can be performed markedly faster.

By the provision of the closure element 6 according to the invention, it is also attained that upon a change of the filler wheel 3, no contact with the sterile parts of the powder dispensing machine 1 occurs. As a result, the expense for sterilizing the machine after changing the filler wheel 3 can be minimized.

The change of the filler wheel can thus be performed using a simple, economical handling device, without a loss of powdered product occurring. As a result, soiling of the machine upon a change of the filler wheel can be prevented. It should also be noted that for maintenance work or the like, for instance, it is understood that the unit comprising the filler wheel 3 and the closure element 6 that is created by means of the pin 17 can also be removed.

The foregoing relates to a preferred exemplary embodiment of the invention, it being understood that other variants and embodiments thereof are possible within the spirit and scope of the invention, the latter being defined by the appended claims.

We claim:

1. An apparatus for metering and dispensing powdered product into containers, comprising a storage chamber (2) for receiving the product, an incrementally rotating filler wheel (3) having at least one metering opening (4, 5), the filler wheel (3) in a first position receiving product from the storage chamber (2) and in a second position dispensing the received product to a container, and a closure element (6), which is disposed adjacent to the filler wheel (3) and can be connected to the filler wheel (3) in such a way that upon a motion of the filler wheel (3) into its replacement position, the closure element (6) is moved into a position disposed below the storage chamber (2), to prevent the escape of product from the storage chamber (2).

2. The apparatus in accordance with claim 1, wherein the closure element (6), on its side located toward the storage chamber (2), has an outer shape (16) which is embodied to correspond to the outer shape of the filler wheel (3).

3. The apparatus in accordance with claim 1, further comprising spring-loaded sealing elements (8) disposed in sealing fashion between the closure element (6) and the storage chamber (2).

4. The apparatus in accordance with claim 2, further comprising spring-loaded sealing elements (8) disposed in sealing fashion between the closure element (6) and the storage chamber (2).

5. The apparatus in accordance with claim 1, further comprising a drive mechanism, for moving the filler wheel (3) and the closure element (6) connected to it from an operating position of the filler wheel (3) into the replacement position of the filler wheel (3).

6. The apparatus in accordance with claim 2, further comprising a drive mechanism, for moving the filler wheel (3) and the closure element (6) connected to it from an operating position of the filler wheel (3) into the replacement position of the filler wheel (3).

7. The apparatus in accordance with claim 3, further comprising a drive mechanism, for moving the filler wheel (3) and the closure element (6) connected to it from an operating position of the filler wheel (3) into the replacement position of the filler wheel (3).

8. The apparatus in accordance with claim 4, further comprising a drive mechanism, for moving the filler wheel (3) and the closure element (6) connected to it from an operating position of the filler wheel (3) into the replacement position of the filler wheel (3).

9. The apparatus in accordance with claim 5, wherein the drive mechanism is embodied as a pneumatic drive mechanism (7).

10. The apparatus in accordance with claim 1, further comprising a changing implement (13) and means for securing the changing implement to the filler wheel (3).

11. The apparatus in accordance with claim 2, further comprising a changing implement (13) and means for securing the changing implement to the filler wheel (3).

12. The apparatus in accordance with claim 3, further comprising a changing implement (13) and means for securing the changing implement to the filler wheel (3).

13. The apparatus in accordance with claim 5, further comprising a changing implement (13) and means for securing the changing implement to the filler wheel (3).

14. The apparatus in accordance with claim 1, wherein the filler wheel (3) can be connected to the closure element (6) by means of a screw connection and/or a clamping connection (17).

15. The apparatus in accordance with claim 2, wherein the filler wheel (3) can be connected to the closure element (6) by means of a screw connection and/or a clamping connection (17).

16. The apparatus in accordance with claim 3, wherein the filler wheel (3) can be connected to the closure element (6) by means of a screw connection and/or a clamping connection (17).

17. The apparatus in accordance with claim 10, wherein the filler wheel (3) can be connected to the closure element (6) by means of a screw connection and/or a clamping connection (17).

18. The apparatus in accordance with claim 1, further comprising a guide element disposed on the closure element (6) for simple installation of the filler wheel (3).

19. A method for replacing a filler wheel (3) in an apparatus (1) for metering and dispensing powdered product into containers, the method comprising the steps of moving the filler wheel (3) from its operating position into a replacement position, and simultaneously moving a closure element (6) connected to the filler wheel (3) into the original operating position of the filler wheel (3) in order to close an outlet (9) from a storage chamber (2) for the product, and releasing the filler wheel (3) from the closure element (6) to enable a replacement of the filler wheel (3).

20. The method in accordance with claim 19, wherein the change in the position of the filler wheel (3) from its operating position to its replacement position is effected by means of a drive mechanism, in particular a pneumatic drive mechanism (7).

* * * * *